US005551820A

United States Patent [19]

Catalano, Jr.

[11] Patent Number: 5,551,820

[45] Date of Patent: Sep. 3, 1996

[54] SHOE HOOK SPIKE AND METHOD OF UTILIZING SAME FOR SECURING A TACKLESS STRIP AGAINST A WALL WHEN INSTALLING CARPET

[76] Inventor: Anthony W. Catalano, Jr., 86 Arch Dr., Holbrook, N.Y. 11741

[21] Appl. No.: 319,459

[22] Filed: Oct. 6, 1994

[51] Int. Cl.[6] ..... F16B 15/02

[52] U.S. Cl. ..... 411/485; 411/488

[58] Field of Search ..... 411/485, 488, 411/496

[56] References Cited

U.S. PATENT DOCUMENTS

| | | | |
|---|---|---|---|
| 446,198 | 2/1891 | Wiskocil | 411/485 |
| 498,890 | 6/1893 | Taylor | 411/485 |
| 615,750 | 12/1898 | Sagebiel | 411/485 |
| 1,711,149 | 4/1929 | Joseph . | |
| 2,314,481 | 3/1943 | Crooks | 411/485 |
| 2,990,565 | 7/1961 | Atwood . | |
| 3,805,862 | 4/1974 | Jirovetz . | |
| 4,759,096 | 7/1988 | Dorris . | |
| 4,796,848 | 1/1989 | Lanz | 411/485 |

FOREIGN PATENT DOCUMENTS

| | | | |
|---|---|---|---|
| 595964 | 7/1959 | Italy | 411/496 |
| 85518 | 5/1955 | Norway | 411/485 |
| 7299 | of 1890 | United Kingdom | 411/485 |

*Primary Examiner*—Steven N. Meyers
*Assistant Examiner*—Gary Estremsky
*Attorney, Agent, or Firm*—Michael I. Kroll

[57] ABSTRACT

A shoe hook spike to secure a tackless strip against a baseboard on a wall at a floor when installing carpet comprising an elongated flat shank. A component at a first end of the elongated flat shank is for receiving blows from a hammer. A structure at a second end of the elongated flat shank is for guiding the elongated flat shank under the baseboard on the wall. An element on the blow receiving component is for engaging with the tackless strip, to retain the tackless strip against the baseboard on the wall at the floor. An edge of the carpet can be held in place on the tackless strip.

1 Claim, 2 Drawing Sheets

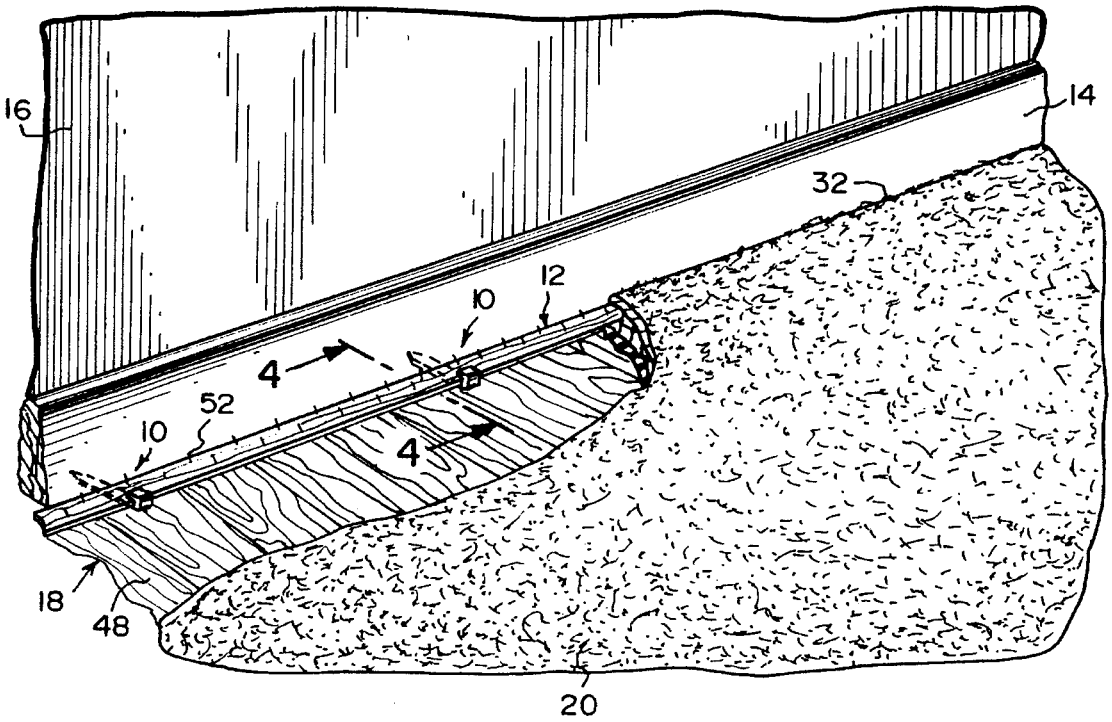
Fig. 1
Fig. 2
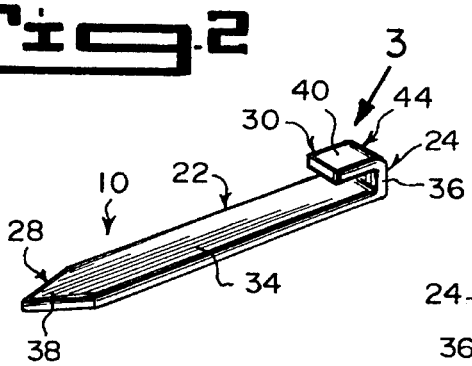
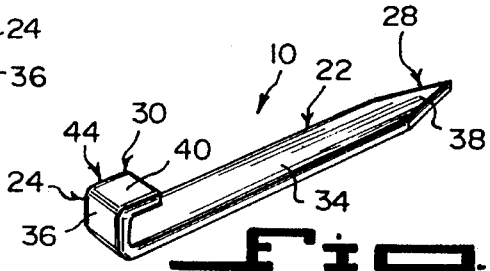
Fig. 3
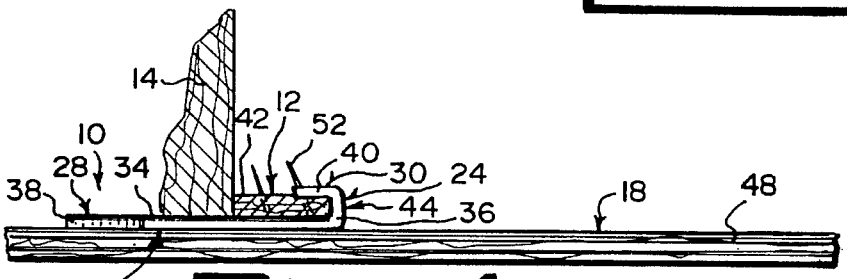
Fig. 4

SHOE HOOK SPIKE AND METHOD OF UTILIZING SAME FOR SECURING A TACKLESS STRIP AGAINST A WALL WHEN INSTALLING CARPET

BACKGROUND OF THE INVENTION

1. Field of the Invention

The instant invention relates generally to carpet fasteners and more specifically it relates to a shoe hook spike.

2. Description of the Prior Art

Numerous carpet fasteners have been provided in prior art that are adapted to hold down the edges of carpeting on floors against walls. For example, U.S. Pat. No. 1,711,149 to Joseph; U.S. Pat. No. 2,990,565 to Atwood, U.S. Pat. No. 3,805,862 to Jirovetz and U.S. Pat. No. 4,759,096 to Dorris all are illustrative of such prior art. While these units may be suitable for the particular purpose to which they address, they would not be as suitable for the purposes of the present invention as heretofore described.

JOSEPH, WILLIAM C.

FASTENING DEVICE FOR FLOOR COVERINGS

U.S. Pat. No. 1,711,149

A fastening device for floor coverings comprising an upright post. A base member is directed outwardly from the base of the post. A hook is directed outwardly from the post and spaced above the base member. A down-turned bill is on the outer end of the hook. A hump is in the base member. A shank extends from the post oppositely from the base member and hook.

ATWOOD, DORIS S.

CARPET FASTENER STRIP

U.S. Pat. No. 2,990,565

A carpet fastener strip comprising a flat strip of metal having one long side thereof shaped to provide coarse pointed teeth projecting in the plane of the strip. The teeth have the top surfaces thereof serrated. The serrations extending longitudinally of the strip and are so pitched that the serrations tend to lock upon withdrawal of the teeth. The strip has the remaining long side bent to form a flange, whose free edge is above the top face of the strip. A rib formed in the strip extends lengthwise thereof laterally away from the top face. The rib defining the base of the teeth. Barbs on the strip extend above the top face of the strip between the flanged edge and rib for engaging carpeting disposed above the top face of the strip.

JIROVETZ, ANDRE J.

CARPET STRIP INSTALLATION APPARATUS

U.S. Pat. No. 3,805,862

A tackless carpet strip is secured to a floor along a wall base plate by a plurality of spaced anchoring brackets which extend transversely of the carpet strip and each includes a flat anchoring member which is pointed at its inner end to be driven under the base plate. Each anchoring member has a pair of upstanding carpet strip flanges which project transversely of the anchoring member and are positioned to receive a carpet strip of predetermined width and hold it a predetermined distance away from the wall. Each anchoring bracket is driven into position under the wall base plate by means of a slotted hammering block which has a transverse slot extending upwardly from the bottom of the block and dimensioned to receive the outer carpet strip flange while a portion of the block contacts the top of the anchoring member between the carpet strip receiving flanges. The hammering block transmits the force of hammer blows on its outer end to the outer end of the anchoring member in such manner that the anchoring member is driven into position under the base plate without bending the outer carpet strip flange.

DORRIS, MARVIN

CARPET FASTENER

U.S. Pat. No. 4,759,096

The present invention is a carpet fastener for securing an edge of an expanse of carpet against a vertical surface having a face board secured thereto. The fastener includes a carpet retaining portion and a face board engaging portion. During installation, the face board engaging portion is inserted into a gap formed between the floor surface and the underside of the face board. Protrusions on the face board engaging portion rigidly secure the fastener so that nails or glue are not required.

SUMMARY OF THE INVENTION

A primary object of the present invention is to provide a shoe hook spike that will overcome the shortcomings of the prior art devices.

Another object is to provide a shoe hook spike, in which the shoe hook spike contains an elongated flat shank having a pointed tip at one end and hook head at an opposite end, whereby the pointed tip can guide the shank under the wall, when the hook head is hit by a hammer, so as to engage with the tackless strip and retain it against the wall.

An additional object is to provide a shoe hook spike that can be used on wooden floors, as well as concrete floors, to retain the tackless strip in place against the wall, so that edges of the carpet can be held in place on the tackless strip.

A further object is to provide a shoe hook spike that is simple and easy to use.

A still further object is to provide a shoe hook spike that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view with parts broken away, showing the instant invention used on a wooden floor for holding a tackless strip in place against a baseboard on a wall.

FIG. 2 is a rear perspective view of the instant invention per se.

FIG. 3 is a front perspective view taken in the direction of arrow 3 in FIG. 2.

FIG. 4 is a cross sectional view taken along line 4—4 in FIG. 1.

DETAILED DESCRIPTION OF THE PREFERRED EMBODIMENTS

Figure 5:
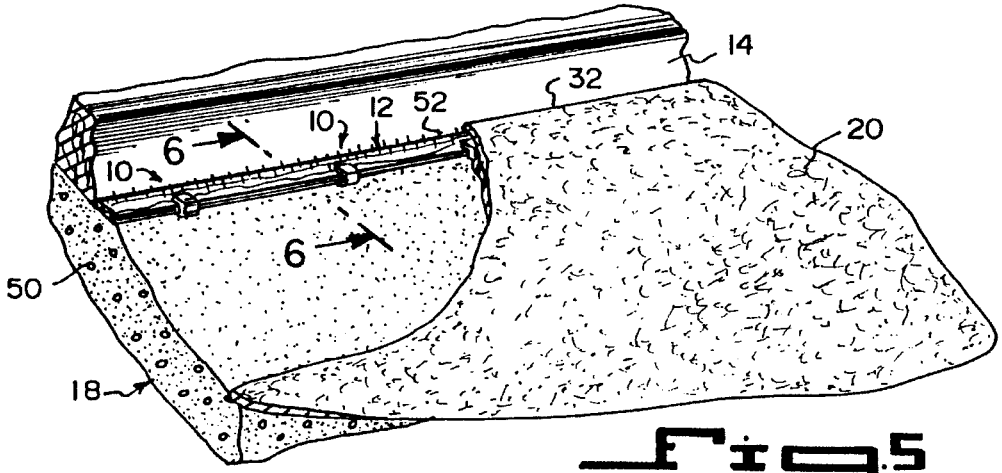
FIG. 5 is a perspective view with parts broken away, similar to FIG. 1, showing the instant invention used on a concrete floor.
Figure 6:
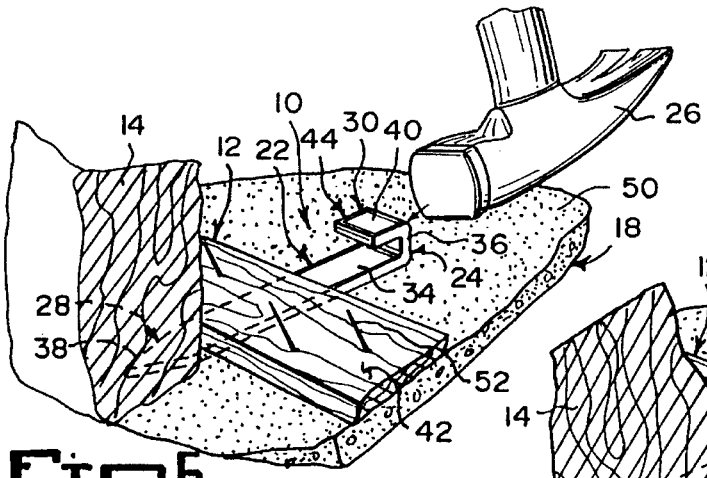
FIG. 6 is an enlarged cross sectional perspective view taken generally along line 6—6 in FIG. 5, showing a first step in installing the instant invention.
Figure 7:
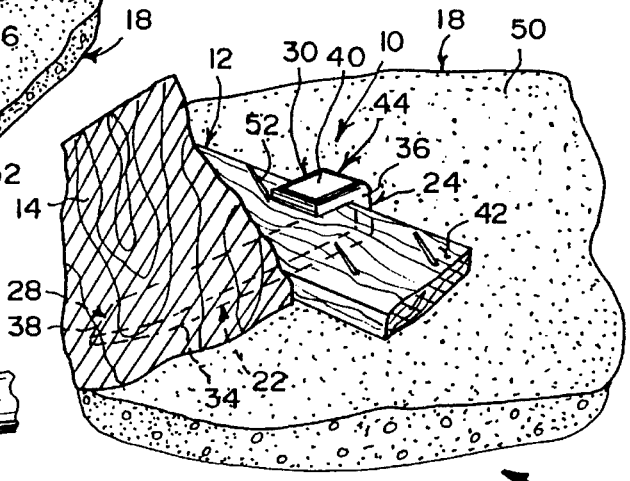
FIG. 7 is a cross sectional perspective view similar to FIG. 6, showing a second step in installing the instant invention.
Figure 8:
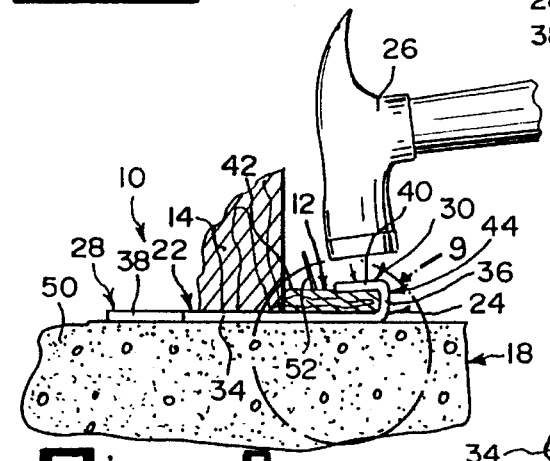
FIG. 8 is a cross sectional side view taken in direction of arrow 8 in FIG. 7, showing a third step in installing the instant invention.
Figure 9:
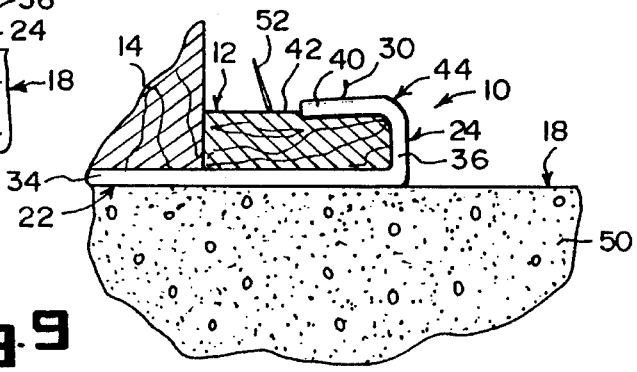
FIG. 9 is a further enlarged cross sectional view of the area indicated by arrow 9 in FIG. 8.

Turning now descriptively to the drawings, in which similar reference characters denote similar elements throughout the several views, FIGS. 1 through 9 illustrate a shoe hook spike 10 to secure a tackless strip 12 against a baseboard 14 on a wall 16 at a floor 18, when installing carpet 20, comprising an elongated flat shank 22. A component 24 at a first end of the elongated flat shank 20 is for receiving blows from a hammer 26. A structure 28 at a second end of the elongated flat shank 22, is for guiding the elongated flat shank 22 under the baseboard 14 on the wall 16. An element 30 on the blow receiving component 24, is for engaging with the tackless strip 12 to retain the tackless strip 12 against the baseboard 14 on the wall 16 at the floor 18. An edge 32 of the carpet 20 can be held in place on the tackless strip 12.

The elongated flat shank 22 is a rectangular shaped plate 34. The blow receiving component 24 is an upstanding flange 36 bent on the first end of the rectangular shaped plate 34. The guiding structure 28 is a pointed tip 38, formed on the second end of the rectangular shaped plate 34.

The engaging element 30 is a lip 40 bent on an upper edge of the upstanding flange 36 and overhangs the rectangular shaped plate 34. The lip 40 can eventually rest upon a top surface 42 of the tackless strip 12. The upstanding flange 36 and the lip 40 in combination form a hook head 44, which will receive the blows from the hammer 26, to drive the pointed tip 38 on the rectangular shaped plate 32 under the baseboard 4 on the wall 16. The hook head 44 will finally engage transversely with the tackless strip 12 to hold the tackless strip 12 in a stationary position against the baseboard 14 on the wall 14 at the floor 18.

The rectangular shaped plate 34 with the pointed tip 38 and the hook head 44 are integral and fabricated out of a durable non-corrosive material 46. The durable non-corrosive material 46 is steel. The floor 18 can be made of wood 48, as in FIGS. 1 and 4. The floor 18 can also be made out of concrete 50, as in FIGS. 5 through 9.

OPERATION OF THE INVENTION

To utilize a plurality of shoe hook spikes 10 for securing the tackless strip against the baseboard 14 on the wall 16 at the floor 18 when installing the carpet 20, the following steps should be taken:

1. Place the tackless strip 12 on the floor 18 against the baseboard 14 on the wall 16, so that steel pins 52 on the tackless strip 12 will face towards the baseboard 14.
2. Insert in spaced apart relationships the pointed tip 38 on each rectangular shaped plate 34 transversely under the tackless strip 12.
3. Strike the upstanding flange 36 of each hook head 44 with multiple blows from the hammer 26, until each lip 40 will eventually rest upon the top surface 42 of the tackless strip 12, so as to hold the tackless strip 12 in a stationary position against the baseboard 14 on the wall 16 at the floor 18.
4. Hit each lip 40 downwardly with a blow from the hammer 26, so that each lip 40 will better engage with the top surface 42 of the tackless strip 12, so as to keep the tackless strip 12 in the stationary position against the baseboard 14 on the wall 16 at the floor 18.

LIST OF REFERENCE NUMBERS

| | |
|---|---|
| 10 | shoe hook spike |
| 12 | tackless strip |
| 14 | baseboard |
| 16 | wall |
| 18 | floor |
| 20 | carpet |
| 22 | elongated flat shank |
| 24 | blow receiving component |
| 26 | hammer |
| 28 | guiding structure |
| 30 | engaging element on 24 |
| 32 | edge of 20 |
| 34 | rectangular shaped plate for 22 |
| 36 | upstanding flange for 24 |
| 38 | pointed tip for 28 |
| 40 | lip for 30 |
| 42 | top surface of 12 |
| 44 | hook head for 36 and 40 |
| 46 | durable non-corrosive material (steel) |
| 48 | wood for 18 |
| 50 | concrete for 18 |
| 52 | steel pin in 12 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skillled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shoe hook spike in combination with a tackless strip and a baseboard on a wall at a floor to secure said tackless strip against said baseboard when installing carpet comprising:

a) an elongated and integral flat shank comprising a rectangular shaped plate in cross section with smooth top and bottom extended surfaces in cross section made of a durable non-corrosive steel material;

b) means consisting of an upstanding flange bent at a first end of said elongated flat shank for receiving blows from a hammer;

c) means consisting of a pointed tip at a second end of said elongated flat shank for guiding said elongated flat shank under the baseboard on the wall; and d) means on said blow receiving means for engaging with the tackless strip to retain the tackless strip in contact with and against the baseboard on the wall at the floor, so that an edge of the carpet can be held in place on the tackless strip, said engaging means consisting of a lip bent on an upper edge of said upstanding flange forming a hook head and overhanging said rectangular shaped plate so that said lip rests upon a top surface of the tackless strip, the lip being deformed by a blow so as to deform and engage said tackless strip thereby clamping said tackless strip between said lip and said shank.

* * * * *